US008550110B2

(12) United States Patent
Trotter

(10) Patent No.: US 8,550,110 B2
(45) Date of Patent: Oct. 8, 2013

(54) TEMPORARY WATERPROOFING SYSTEMS AND METHODS

(76) Inventor: Robert Mike Trotter, Doraville, GA (US)

( * ) Notice: Subject to any disclaimer, the term of this patent is extended or adjusted under 35 U.S.C. 154(b) by 642 days.

(21) Appl. No.: 12/683,175

(22) Filed: Jan. 6, 2010

(65) Prior Publication Data

US 2010/0319296 A1 Dec. 23, 2010

Related U.S. Application Data

(60) Provisional application No. 61/219,498, filed on Jun. 23, 2009.

(51) Int. Cl.
*F16L 3/00* (2006.01)

(52) U.S. Cl.
USPC ..... 137/362; 137/565.15; 137/312; 417/36

(58) Field of Classification Search
USPC ..... 137/15.01, 362, 565.15, 312; 52/302.1, 52/169.5; 417/36, 40; 405/107
See application file for complete search history.

(56) References Cited

U.S. PATENT DOCUMENTS

| | | | | |
|---|---|---|---|---|
| 3,344,569 | A | 10/1967 | Cotten | |
| 3,975,467 | A | 8/1976 | Beck | |
| 4,198,794 | A * | 4/1980 | Younts, Jr. | 52/302.3 |
| 4,244,385 | A * | 1/1981 | Hotine | 137/1 |
| 4,265,064 | A | 5/1981 | Parezo | |
| 4,295,793 | A * | 10/1981 | McGalliard | 417/36 |
| 4,798,034 | A * | 1/1989 | Jarnagin et al. | 52/302.3 |
| 4,909,274 | A * | 3/1990 | Rodriguez | 137/312 |
| 4,912,587 | A * | 3/1990 | Kurz | 361/23 |
| 5,133,167 | A | 7/1992 | Drew et al. | |
| 5,367,842 | A | 11/1994 | Janesky | |
| 5,642,967 | A * | 7/1997 | Swain et al. | 405/229 |
| 5,738,139 | A * | 4/1998 | DeChard | 137/312 |
| 6,337,024 | B1 * | 1/2002 | Hammonds | 210/739 |
| 6,474,952 | B1 * | 11/2002 | Fisher et al. | 417/40 |
| 6,550,190 | B2 | 4/2003 | Ruiz et al. | |
| 6,640,502 | B2 | 11/2003 | Mueller | |
| 6,904,723 | B1 * | 6/2005 | Moore et al. | 52/169.5 |
| 7,712,998 | B2 * | 5/2010 | Salemie | 405/111 |
| 2006/0283102 | A1 * | 12/2006 | Sourlis | 52/62 |
| 2008/0078142 | A1 * | 4/2008 | Andras | 52/741.3 |
| 2009/0123296 | A1 * | 5/2009 | Bialick et al. | 417/36 |

* cited by examiner

*Primary Examiner* — Craig Schneider
*Assistant Examiner* — Angelisa Hicks
(74) *Attorney, Agent, or Firm* — Robert R. Elliott, Jr., Esq.; Benjamin C. Wiles, Esq.; Troutman Sanders LLP

(57) ABSTRACT

Systems for removing water from an area where water is not desired are discussed and provided. The system can include a dam, a water collection system, and a water removal system. The dam can create a waterproof seal so that the dam is configured to define a reservoir, or retention area, capable of holding water. The water collection system can remove substantially all of the water that collects in the retention area and deposit the water in a reservoir when the water collection system is triggered by a first sensor. The water removal system can move the water collected in the reservoir to an area of safe disposal through a hose or drain when triggered by a second sensor. Other aspects, features, and embodiments of the present invention are claimed and described.

16 Claims, 8 Drawing Sheets

TEMPORARY WATERPROOFING SYSTEMS AND METHODS

CROSS REFERENCE TO RELATED APPLICATION AND PRIORITY CLAIM

This application claims the benefit, under 35 U.S.C. §119 (e), of U.S. Provisional Patent Application No. 61/219,498, filed 23 Jun. 2009, the entire contents and substance of which is incorporated herein by reference in its entirety as if fully set forth below.

TECHNICAL FIELD

Embodiments of the present invention relate generally to containing and removing accumulated moisture. More particularly, embodiments of the present invention relate to temporary systems for removing water that can be installed quickly. The systems can be operational at least until permanent measures can be put into place, and can be removed with minimal effort.

BACKGROUND

Foundations and exterior walls of buildings often experience water problems due to a variety of causes. When exterior walls that are below grade are constructed, the surrounding soil must be removed prior to construction. The soil is then replaced after the foundation and walls are complete. As a result, the exterior walls can become damaged as soil settles outside of the foundation. A negative grade sloping toward the exterior walls can also be formed due to such settling. With the negative grade, the force of gravity causes water and soil to move toward the walls, which can create positive hydrostatic pressure. This pressure can cause cracking of, and seepage through, the exterior walls and floor allowing moisture to enter the building.

Additional water problems can be caused by water accumulating around and under walls and foundations. This can be caused by, for example, rising ground water during rainy parts of the year. All of these sources are especially prevalent in basements and crawl spaces. When water enters a dwelling, regardless of source, many problems arise, including, among other things, damage to the physical structure of the dwelling and a decrease in indoor air quality.

Conventional systems exist to control or direct water seepage thorough the interior walls of a structure. These systems often require extensive time and/or extensive modification of the structure to install. A rainy season, flooding, and other factors can create a backlog for service providers attempting to provide water mitigation services. This can create a situation in which water sits inside the dwelling for extended periods until the service provider can affect the necessary repairs.

Standing water inside a dwelling can create health problems related to, for example, mold, mildew, bacteria, viruses, and insects (e.g., mosquitoes). Water inside the structure can also cause structural problems. The problems can include, among other things, wood rot and fastener corrosion. Owners may spend thousands of dollars drying structures to prevent such damage, only to have the structure flooded again before a service provider can affect a permanent repair.

BRIEF SUMMARY OF EXEMPLARY EMBODIMENTS

A system for removing water from areas where water is undesirable is disclosed. The system can be installed quickly, without modification to the installation area. The system can provide a temporary water removal solution until a more permanent solution can be installed in the area. The system can be useful, for example and not limitation, during periods of heavy rain, when service providers may encounter backlogs due to high demand. The system can provide ease of installation and can be removed from a structure without making permanent modifications to the structure.

In accordance with some embodiments, the system can comprise a dam, in watertight communication with a substrate, for sequestering water in a retention area. In some embodiments, the dam can comprise a substantially rigid material. In this configuration, the dam can further comprise a sealer for forming a substantially watertight seal between the dam and one or more of the substrate and one or more walls.

The system can further comprise a water collection system, in fluid connection with the retention area, for removing water from the retention area to a reservoir. A water removal system can be provided for removing the water from the reservoir to a disposal location. In some embodiments, the dam can be in watertight communication with the substrate and one or more walls to form a retention area.

In some embodiments, the water collection system can comprise a first conduit in fluid communication with the retention area and the reservoir. The first conduit can provide communication between a vacuum and the reservoir. The first conduit can enable the vacuum to draw water out of the retention area and into the reservoir. The system can be equipped with a sensor for activating and deactivating the vacuum motor based on the water level in the retention area.

In accordance with some embodiments, the water removal system can comprise a pump for removing water from the reservoir. The pump can be in communication with a disposal area via a second conduit. The system can be equipped with a second sensor for activating and deactivating the pump based on the water level in the reservoir. In some embodiments, the second conduit can be in fluid communication with a drain disposed inside the structure and the drain can be in fluid communication with the disposal location.

In some embodiments, the first sensor can activate the vacuum motor when the water level in the retention area reaches a first predetermined level and can deactivate the vacuum motor when the water level in the retention area reaches a second predetermined level. In still other embodiments, the second sensor can activate the pump when the water level in the reservoir reaches a first predetermined level and can deactivate the pump when the water level in the reservoir reaches a second predetermined level.

The system can also include additional features. For example, the first conduit can further comprise a first valve to prevent water from draining out of the first conduit and back into the retention area when the vacuum motor is deactivated. Similarly, the second conduit can comprise a second valve to prevent water from draining out of the second conduit and back into the reservoir when the pump is deactivated. The first conduit can further comprise a nozzle comprising a plurality of channels to channel water into the first conduit. Similarly, the second conduit can further comprise a baffle for smoothing the flow of water out of the second end of the second conduit.

Embodiments of the present invention can also comprise a method for removing water from unwanted areas. The method can comprise installing a dam to create a retention area. An additional feature of the method can comprise placing a water collection and removal system in fluid communication with the retention area. In some embodiments, the water collection and removal system can be placed in fluid communication with a disposal location. When possible, the disposal location can be an existing drain. The water collection and removal system can be provided with a power source or can have an internal power source.

To install the dam and create a retention area, a portion of the bottom and/or the sides of the dam can be covered with sealant. When the desired sealant has been placed on the dam, the dam can be placed in communication with a substrate and/or one or more walls to form a substantially watertight retention area. In some installations, it may be desirable to adjust the height of a first conduit within the retention area such that the first conduit is in close proximity to the substrate.

Additional repairs may be necessary if the walls and/or floor of the installation area are cracked or damaged. In some embodiments, the method can further comprise drilling a hole in a crack in one or more of the substrate and one or more walls where the dam will span the crack after installation. After drilling, the hole can be filled with a sealant prior to installing the dam to create a water tight seal between the dam and one or more of the substrate and the one or more walls after installation.

The foregoing and other objects, features, aspects, and advantages of the present invention will become more apparent from the following detailed description of the present invention when taken in conjunction with the accompanying drawings.

DETAILED DESCRIPTION

Embodiments of the present invention are directed to a temporary waterproofing system. The system can be installed quickly to remove unwanted water. In some embodiments the system can comprise a dam for sequestering, or pooling, water in a retention area. The water can be removed from the retention area, using a vacuum or other suitable means, to a reservoir. The water can then be removed to a drain, or other safe area, using a pump, or other suitable means. The system can maintain a relatively dry environment until a more permanent solution can be installed.

To facilitate an understanding of the principles and features of the invention, it is explained with reference to its implementation in an illustrative embodiment. Embodiments of the present invention can be quickly installed in a basement, crawlspace, or other area with water infiltration and provide removal of the water until a permanent waterproofing repair can be put in place. Additionally, because embodiments of the present invention can be installed quickly, in times of high demand, service providers can provide a temporary waterproofing solution to prevent additional structural damage due to backlogs.

Embodiments of the invention, however, are not limited to use in basements or crawl spaces. Rather, embodiments of the invention can be used in any location where water accumulation is undesirable. These locations can include, for example and not limitation, parking garages, overpasses, storage areas, and the bilges of ships.

The materials described as making up the various elements of the system of the invention are intended to be illustrative and not restrictive. Many suitable materials that would perform the same or a similar function as the materials described herein are intended to be embraced within the scope of the invention. Such other materials not described can include, but are not limited to, materials that are developed after the time of the development of the invention, for example.

Figure 1:
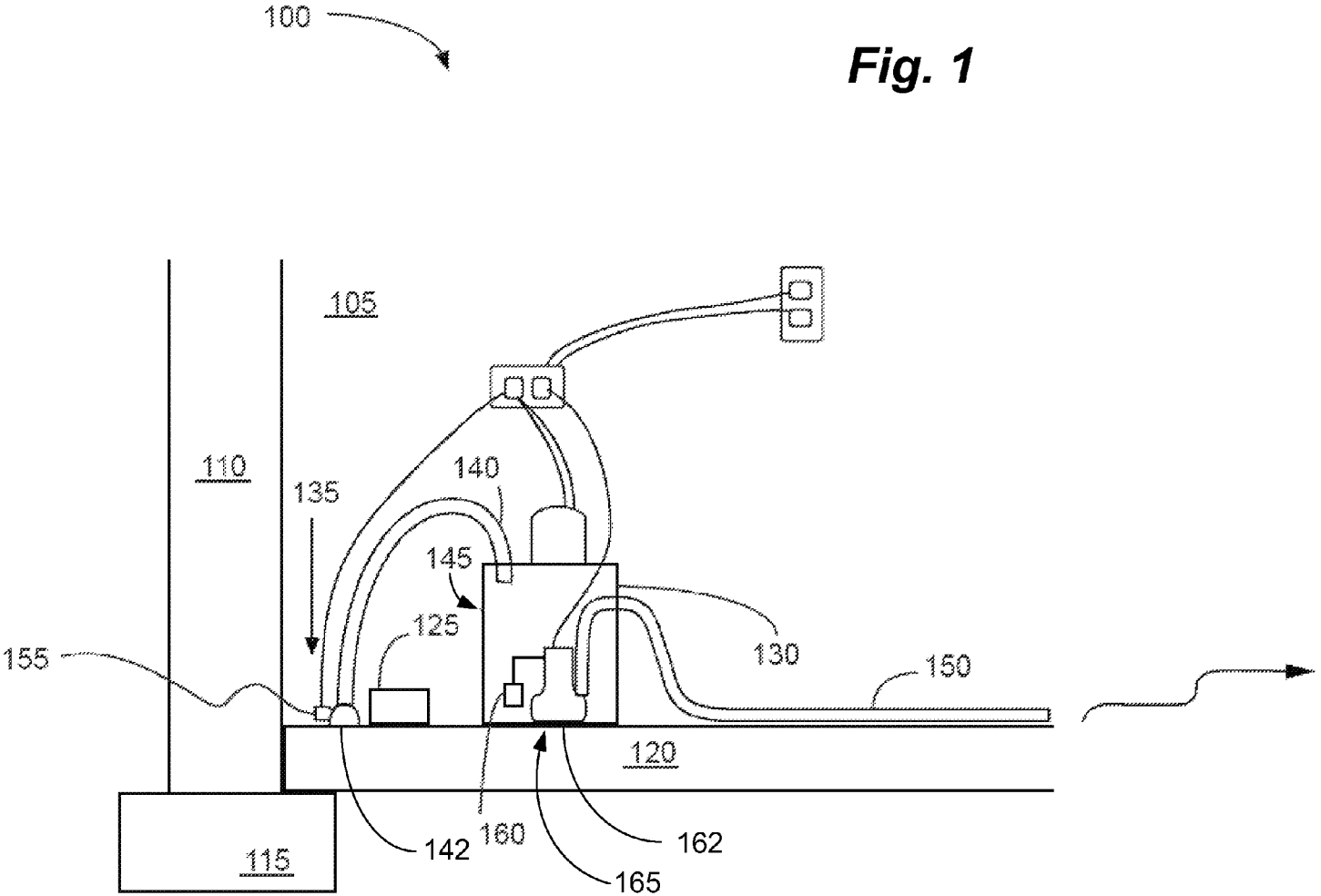
FIG. 1 depicts a side view of a water collection and removal system embodiment in accordance with some embodiments of the present invention.

Referring now to the figures, FIG. 1 depicts a side view of a water collection and removal system embodiment in accordance with some embodiments of the present invention. Embodiments of the present invention can comprise a water collection and removal system 100 for removing water from, for example, a structure 105. The structure 105 can be of a conventional design comprising a footing 115 onto which a wall 110 and a floor 120 are constructed, though other configurations are contemplated. Water seeping into the structure 105 can be caused by, among other things, excessive hydrostatic pressure, wall 110 and/or floor 120 cracks, and flooding.

In some embodiments, the system 100 can comprise a water collection system 145, a water removal system 165, and a dam 125. The dam 125 can be used to confine water to a portion 135, or retention area, of the structure 105. In other words, the dam 125 can prevent the water from spreading across the surface of the floor 120. The dam 125 can cause the water to pool in the retention area 135 for removal.

In some embodiments, one or more dams 125 can be installed to create a retention area 135. The dam 125 can be installed in multiple configurations depending on, among other things, room layout and location of water infiltration. The dam 125 can be installed, for example, from one wall 110 to another wall to trap water between the two walls 110 and the floor 120. This can form a substantially triangular retention area 135. In other embodiments, the dam 125 can be flexible and can create a substantially semicircular retention area 135 between a single wall 110 and the floor 120. Alternatively, the dam 125 can be formed into a substantially circular retention area 135 on a particular portion of the floor 120.

The dam 125 can be in watertight communication with the wall 110 and/or the floor 120. In other words, the dam 125 can be capable of forming a substantially watertight seal between the wall 110 and or the floor 120. The dam 125 can sequester water between the dam 125 and wall 110 and/or floor 120. In some embodiments, the dam 125 can comprise a soft, flexible material that enables it to conform to many different shapes and textures. The dam 125 can be self-adhesive, or can be affixed using, for example, an adhesive, sealant, or caulk. The dam 125 is preferably attached using an adhesive that can provide a secure, watertight seal between varieties of surfaces, yet can be easily removed with a minimum of cleanup and/or damage to the underlying substrate.

In some embodiments, the dam 125 can comprise a rigid material such as, for example and not limitation, plastic, metal, or wood. The dam 125 can be treated with a waterproofer. The dam 125 can be installed using, for example, a caulk or adhesive suitable to attach the dam 125 to the floor 120 and/or wall 110 and creating a watertight seal therebetween. In some embodiments, it may be desired to provide additional support for the dam 125. This can be achieved by affixing it to the floor 120 and/or wall 110 using, for example and not limitation, ballistic fasteners, epoxy, or lag bolts.

In some embodiments, the dam 125 can be of composite construction. In other words, the dam 125 can comprise two or more layers. One layer of the dam 125 can comprise a rigid material such as, for example and not limitation, plastic, metal, or wood. Another layer of the dam 125 can comprise a pliable material on sealing surfaces, i.e., where it meets the wall 110 and/or floor 120. This can enable the dam 125 to self-seal so that it can be wedged into place. This can obviate the need for adhesives or caulks and can expedite removal and cleanup.

In some embodiments, the water collection system 145 can further comprise a first conduit 140. The first conduit 140 can be in fluid communication with the retention area 135 and the collection system 145. The first conduit 140 can be, for example and not limitation, a length of rubber or plastic hose (e.g., garden hose). In some embodiments, the first conduit 140 can comprise, for example and not limitation, a plastic vacuum hose or a rigid PVC pipe.

In some embodiments, the end 142 of the first conduit 140 can comprise a nozzle 142. In some embodiments, the nozzle 142 can have multiple holes to enable the collection system 145 to remove water through 360 degrees around the first conduit 140. The nozzle 142 can further comprise, for example and not limitation, a screen or filter to prevent debris from clogging the first conduit 140.

The collection system 145 can further comprise a sensor 155 located at or near the end 142 of the conduit. The sensor 155 can detect the presence of water and can provide a signal to activate the collection system 145. The sensor 155 can be, for example and not limitation, a float switch, a resistance-based switch, or an optical switch (e.g., an infrared laser). The sensor 155 can be set to trip, or close, when the height of the water in the retention area 135 reaches a specific height (the "removal height"). In some embodiments, this can be achieved by mounting the sensor 155 at the desired height on the first conduit 140. In other embodiments, the sensor 155 can have an integral means for setting the removal height (e.g., an adjustable float).

When the sensor 155 detects that the water level has reached the removal height, the sensor 155 activates the collection system 145. In some embodiments, the sensor 155 can simply complete the circuit between the collection system 145 and power or ground to activate a motor in the collection system 145. In other embodiments, the sensor 155 can be connected to, for example, a relay, controller, or microprocessor capable of activating the collection system 145.

In some embodiments, the sensor 155 can also detect when the water level has dropped to a suitable level and can deactivate the collection system 145. So, for example, the sensor 155 can be a float switch and can activate the collection system 145 when the float rises to a first predetermined height. The sensor 155 can then deactivate the collection system 145 when the float drops to a second predetermined height. Deactivation can be accomplished, for example and not limitation, by opening the ground or power circuit to the collection system 145. In other embodiments, the collection system 145 can be controlled by a timer and can simply run for a predetermined time.

The collection system 145 can be a vacuum or a pump capable of removing the water from the retention area 135 and collecting it in a reservoir 130. It is preferable for the collection system 145 to remove as much water as possible from the retention area 135. This minimizes the amount of standing water in the structure 105. In an exemplary embodiment, the collection system 145 can be a vacuum and the reservoir 130 can be the canister of the vacuum.

The system 100 can further comprise a water removal system 165. The water removal system 165 can be in fluid communication with the reservoir 130 of the collection system 145. In some embodiments, the water removal system 165 can be inside the reservoir 130. The water removal system 165 can comprise, for example, a pump 162 and a sensor 160. In some embodiments, the pump 162 can comprise, for example and not limitation, a centrifugal or reciprocating pump. In a preferred embodiment, the design of the pump 162 can enable the pump to operate when dry without damage. In other words, the pump 162 does not "burn-out" if run without fluid.

The water removal system 165 can further comprise a sensor 160 located at or near the pump 162. The sensor 160 can detect the presence of water and can provide a signal to activate the pump 162. The sensor 160 can be, for example and not limitation, a float switch, a resistance-based switch, or an optical switch (e.g., and infrared laser). The sensor 160 can be set to trip, or close, when the height of the water in the reservoir 130 reaches a specific height. This can be achieved by mounting the sensor 160 at the desired height on the pump 162. In some embodiments, the sensor 160 can have an integral means for setting the height (e.g., an adjustable float).

When the sensor 160 detects that the water level has reached a certain height, the sensor 160 can activate the pump 162. In some embodiments, the sensor 160 can simply complete the circuit between the pump 162 and power or ground. In other embodiments, the sensor 160 can be connected to, for example, a relay, controller, or microprocessor capable of activating the pump 162.

In an exemplary embodiment, the pump 162 can be a sump pump and the sensor 160 can be a float switch. When the water inside the reservoir 130 reaches the set height, the pump 162 activates and substantially empties the reservoir 130. In some embodiments, the pump 162 can be connected to a second conduit 150. The second conduit 150 can be, for example and not limitation, PVC pipe, garden hose, or clear plastic tubing. The second conduit 150 can be connected to, among other things, a drain or sink inside the structure 105. In some embodiments, the second conduit can simply exit the structure 105.

In some embodiments, the structure 105 may not be equipped with a drain or the drain may not be accessible. If the portion of the structure with water infiltration is located below ground, it can also be difficult or impossible to remove the water from the structure via a second conduit 150. In this situation, therefore, it can be necessary for the reservoir 130 to be larger. In other words, when no convenient route exists for water removal, it can be necessary to increase the size of the reservoir 130. This minimizes the number of times the reservoir 130 must be emptied in a given period. In some embodiments, therefore, the system 100 can simply collect the water in the reservoir 130 to be emptied periodically.

Figure 2A:
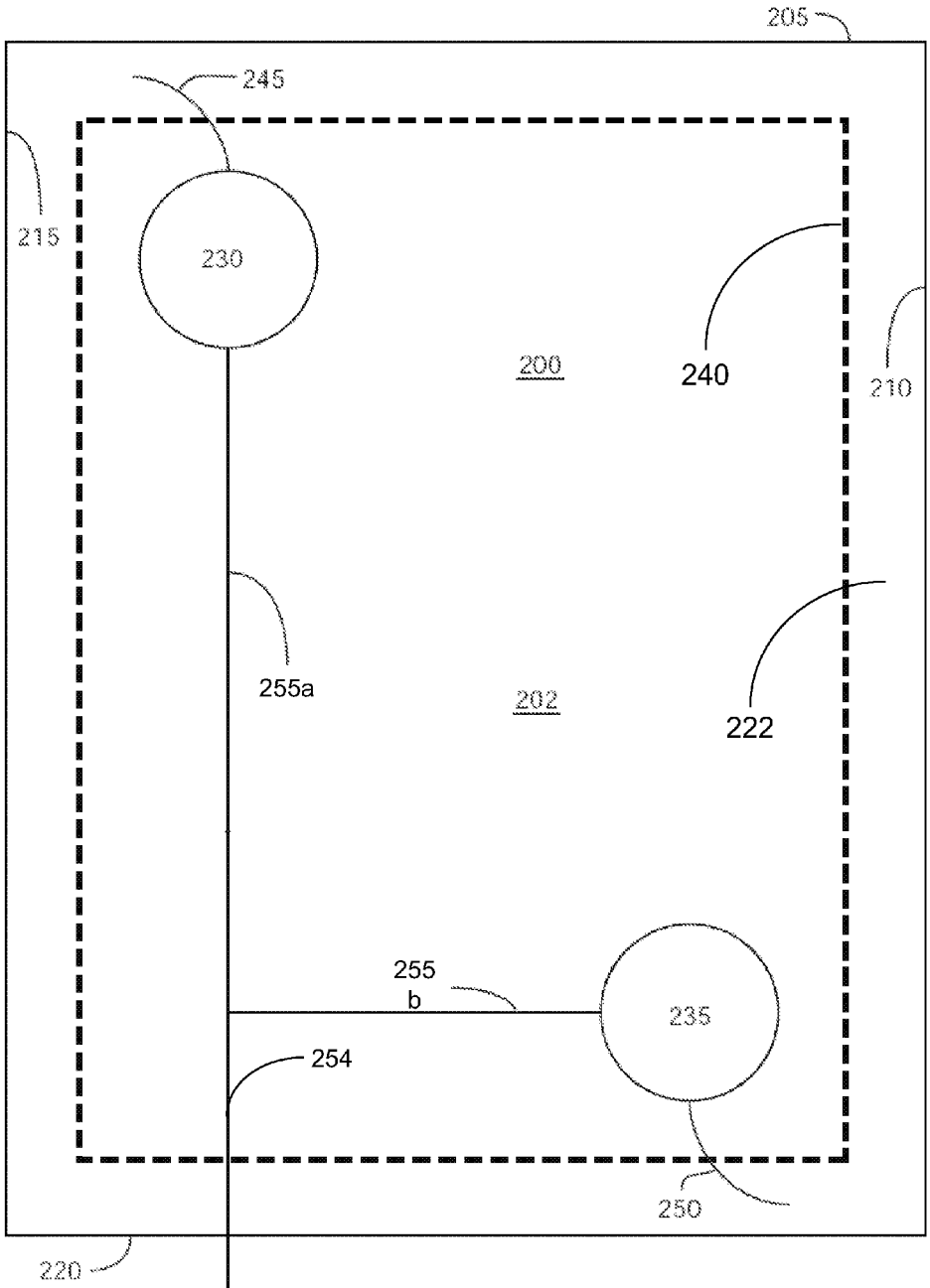
FIG. 2A depicts a schematic view of two water collection and removal system embodiments in accordance with some embodiments of the present invention.

FIG. 2A depicts a schematic view of two water collection and removal systems in accordance with some embodiments of the present invention. In some embodiments, based on the volume of water that must be removed, it can be desirable to install two water collection and removal systems 230, 235. If water is infiltrating all four walls 205, 210, 215, 220 of a room, for example, it can be necessary to install a dam 240 around the perimeter of the room 200. This can substantially create a moat, or retention area 222, around the room 200. The moat can collect water and prevent water from covering substantially the entire floor 202. In this way, a majority of the room 200 can be kept dry. This can prevent, for example, damage to items stored in the room 200 or the flooring installed over the floor surface 202.

The systems 230, 235 can be in fluid communication with the retention area 222 via conduits 245, 250. The systems 230, 235 can remove water from the retention area 222 when the water level reaches the removal height, e.g., one-quarter of an inch. In this way, the retention area 222 can be kept substantially dry. This can substantially reduce problems arising from the presence of standing water.

Each of the systems 230, 235 can be in fluid communication with a tube 255*a*, 255*b*. The tube 255*a*, 255*b* can be in fluid communication with, for example, a drain 254. In some embodiments, the systems 230, 235 can be connected to a hose 254, or other means, that simply exits the building to a suitable location. In some embodiments, the systems 230, 235 may have separate drains (not shown).

Figure 2B:
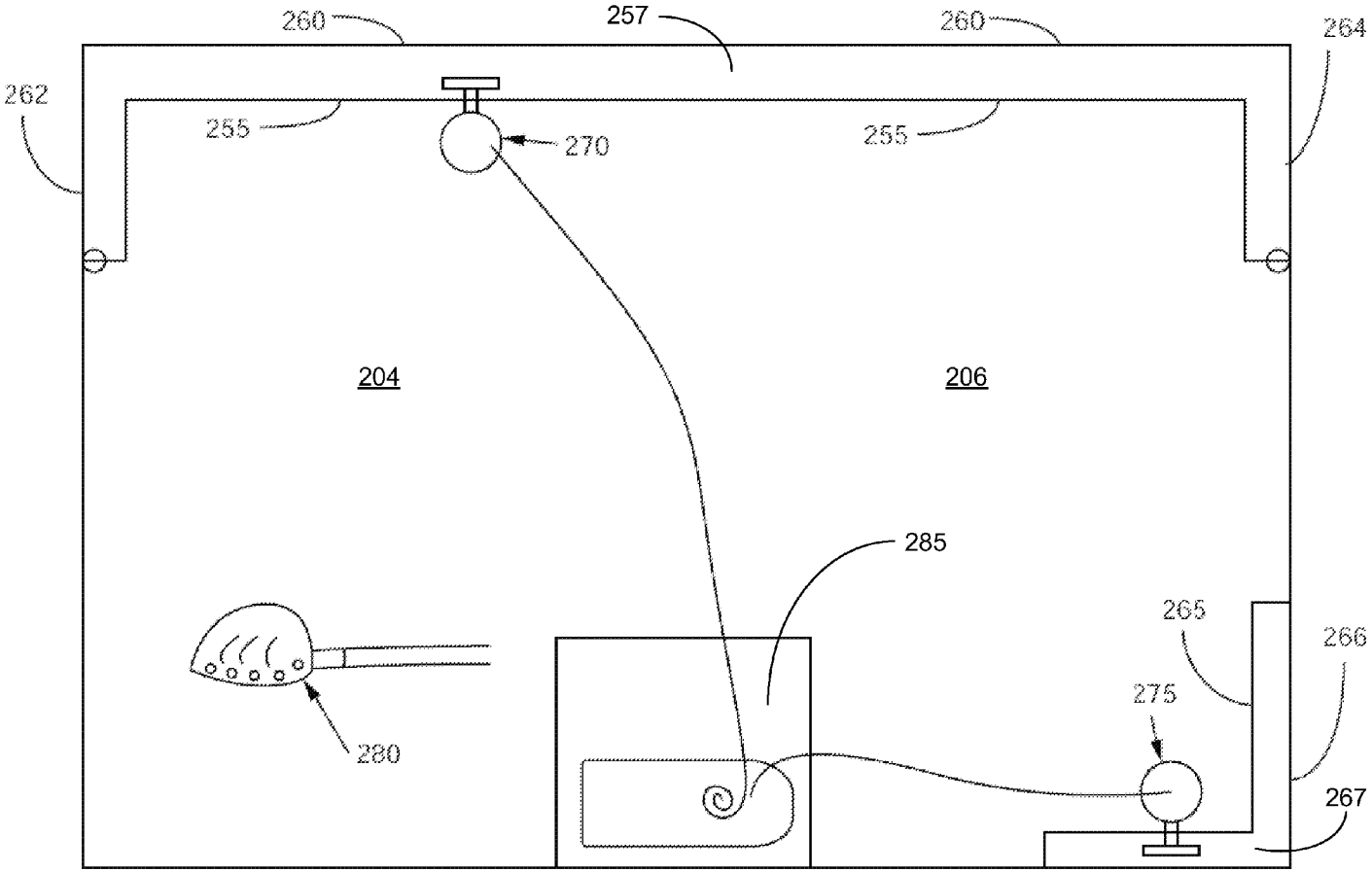
FIG. 2B depicts another schematic view of two water collection and removal systems embodiments, including a baffle, installed in a structure, in accordance with some embodiments of the present invention.

Many configurations of the present invention can be employed based on the needs presented by a particular situation. FIG. 2B depicts another schematic view of two water collection and removal systems embodiments. The system 100 can be deployed in a room 204 in which water infiltration affects substantially all of one wall 260, but only a corner of another wall 266. Multiple dams 255, 265 can be used to create multiple retention areas 257, 267, as needed.

In this embodiment, a dam 255 can be placed along substantially the entire first wall 260 and continue partially along the adjoining walls 262, 264. The dam 255, therefore, can be sealed along the surface of the floor 206 and can be sealed against the walls 262, 264 to contain water in a retention area 257. When the water level reaches the removal level, e.g., one-quarter of an inch, the system 270 can remove the water. When the water level inside the system 270, i.e., in the reservoir 130, reaches a set height, the water can then be pumped out to a suitable location 285 for removal, e.g. a drain. The drain 285 can be, for example and not limitation, a tub drain, a sink, a floor drain, or a washing machine drain. If no drain is available, the system can simply use a hose or conduit that exits the building.

A second system 275 can service a second retention area 267 formed by the dam 265 in the corner of the room 204. In some embodiments, the second system 275 can share a common drain 285 with the first system 270. In some embodiments, the second system 275 can have a separate drain 285 from the first system 270. More or less systems 270, 275 can be employed, as necessary, to meet the water removal demands in a given room 204.

In some embodiments, a baffle 280 can be employed. The baffle 280 can be disposed on the end of the first conduit 140. The baffle 280 can prevent large debris from being sucked into and clogging the first conduit 140. The baffle 280 can also be disposed on the end of the second conduit 150. In this configuration, the baffle 280 can slow and smooth water flow exiting the second conduit 150 into the drain 285. This can prevent, for example, exceeding the removal capacity of the drain 285. The baffle 280 can also prevent splashing and water damage to areas surrounding the drain 285.

Figure 3:
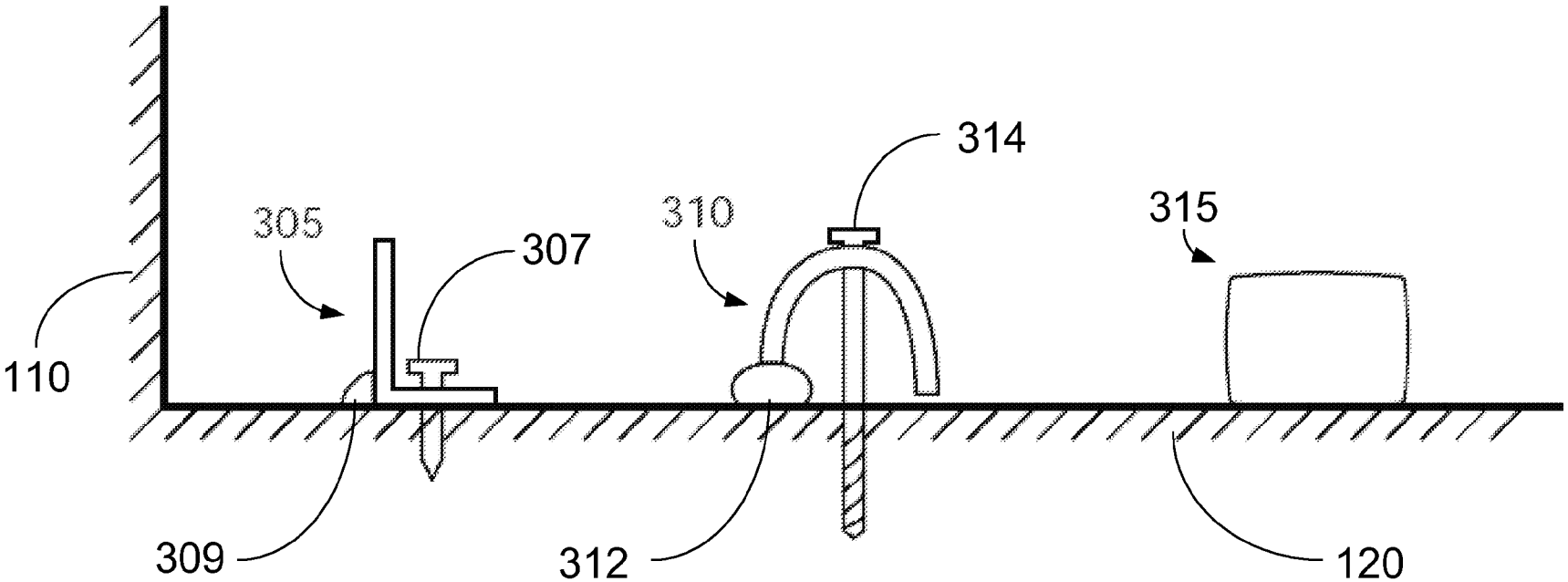
FIG. 3 depicts various cross-sectional configurations for a dam for use with the water collection and removal system embodiment, in accordance with some embodiments of the present invention.

FIG. 3 depicts various cross-sectional configurations for a dam for use with the water collection and removal system embodiment, in accordance with some embodiments of the present invention. The dam 125 can be many shapes and materials and can provide a water tight seal at the floor 120 and/or wall 110. In some embodiments, the dam 305 can be substantially L-shaped. In this configuration, the dam 305 can be attached to the floor 120 using, for example and not limitation, a nail 307, screw, or adhesive. The dam 305 can then be made watertight by placing a bead of caulk or adhesive 309 at the base of the dam 305. In some embodiments, the caulk or adhesive 309 can be disposed between the dam 305 and the floor 120 and/or wall 110. The use of caulk or adhesive 309 can obviate or mitigate the need for additional fasteners 307.

In some embodiments, the dam 310 can comprise a firm but flexible material. The dam 310 can form a half pipe shape with a pliable bulb 312 attached on one side. The bulb 312 can comprise a material suitable for creating a water tight seal with the floor 120 and/or wall 110 such as, for example and not limitation, rubber or silicone. In some embodiments, the dam 310 can be placed against the floor 120 in tension and fastened to the floor with a suitable fastener 314. The tension can force the pliable bulb 312 against the floor 120 creating a water tight seal. The fastener 314 can be, for example and not limitation, a nail or screw suitable for fastening the dam 310 to the floor 120.

In some embodiments, the dam 315 can comprise a solid, but pliable material suitable for creating a watertight seal with the floor 120. The dam 315 can comprise, for example, a block of soft, jelly-like rubber. In some embodiments, the dam 315 can comprise a material that can be cut to length. This can enable the dam 315 to be wedged between, for example, two walls 110. The dam 315 can also be affixed to the floor 120 and/or wall 110 using a suitable adhesive or caulk. In some embodiments, the dam 315 can also be affixed to the floor 120 and/or walls 110 using a suitable fastener (e.g., nail, screw, bolt, etc.).

Figure 4:
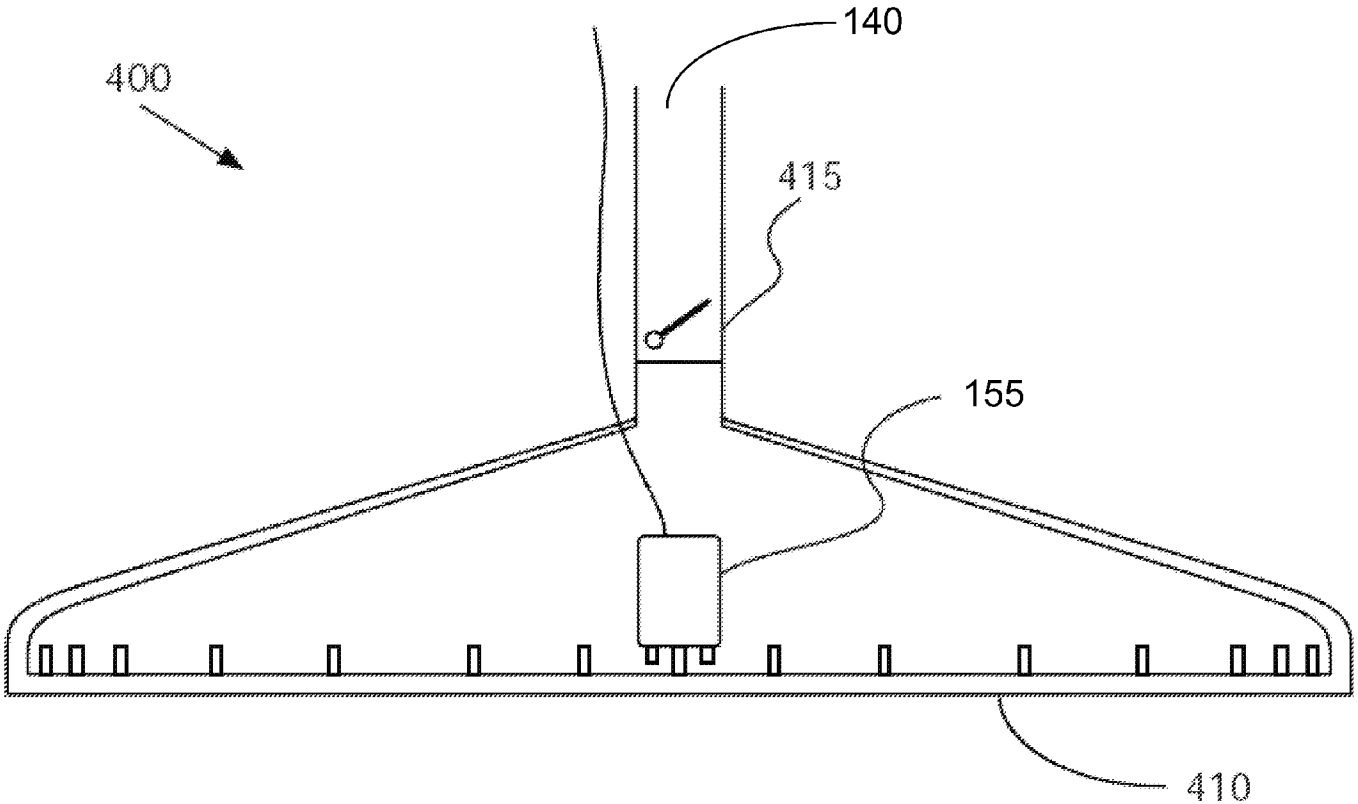
FIG. 4 depicts a nozzle for use with the water collection and removal system in accordance with some embodiments of the present invention.

FIG. 4 depicts a nozzle for use with the water collection and removal system 100 in accordance with some embodiments of the present invention. The nozzle 400 can comprise a plurality of slots 410. The nozzle 400 can increase the surface area of the first conduit 140, which can increase the efficiency of water removal and prevent clogging of the first conduit 140. In some embodiments, the conduit can further comprise a screen or filter (not shown) to prevent clogging of the first conduit 140.

In some embodiments, the nozzle 400 can further comprise a valve 415. In some embodiments, the valve 415 can be a simple on/off valve such as, for example, a ball valve. This type of valve can be useful when installing or removing the system 100 to prevent water dripping from the first conduit 140. In some embodiments, the valve 415 can comprise a one-way, or backflow, valve. This can prevent water that has been sucked into the first conduit 140 draining back into the retention area 135 when the water collection system 145 is deactivated. The valve 415 can minimize the amount of standing water in the retention area 135.

The nozzle 400 can further comprise a fixed or adjustable sensor 155. In some embodiments, the sensor 155 can be mounted on the inside of the nozzle 400 to protect it from damage. As described above, the sensor 155 can detect the level of the water in the retention area 135 and activate the water collection system 145. In some embodiments, the sensor 155 can also deactivate the water collection system 145 when the water level drops sufficiently. In some embodiments, the sensor 155 can be disposed on the outside of the nozzle 400. In some embodiments, the mounting height of the nozzle 400 can determine when the water collection system 145 is activated and/or deactivated.

Figure 5:
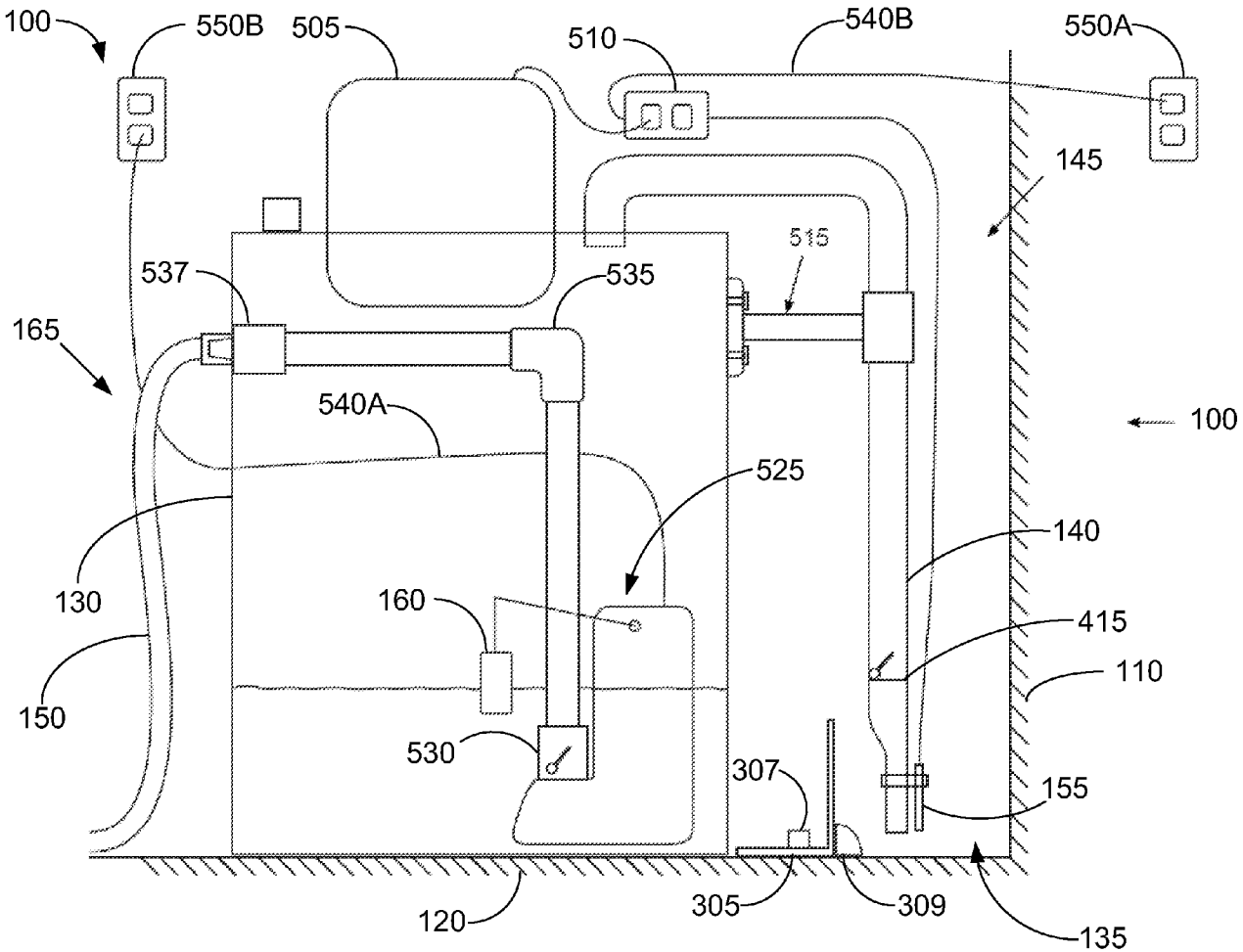
FIG. 5 depicts a detailed, side view of the water collection and removal system of FIG. 1 in accordance with some embodiments of the present invention.

FIG. 5 depicts a detailed, side view of the water collection and removal system of FIG. 1 in accordance with some embodiments of the present invention. The system 100 can comprise a water collection system 145 and a water removal system 165. The water collection system 145 can comprise a first conduit 140 in fluid communication with a retention area 135. The retention area 135 can be created between the dam 305, the floor 120, and the wall 110. In some embodiments, as shown in FIG. 5, the dam 305 can be substantially L-shaped. This can enable the dam 305 to be attached to the floor using a suitable fastener 307. A watertight seal can be formed between the base of the dam 305, for example, a bead of caulk or adhesive 309.

The first conduit 140 can further comprise a sensor 155. The sensor can detect the water level in the retention area 135. The water collection system 145 can further comprise a vacuum motor 505 and a reservoir 130. In some embodiments, the first conduit 140 can be supported using a brace 515 to retain the first conduit 140 in the reservoir 130. The brace 515 can prevent, for example, vibration, flexing, and cracking of the first conduit 140. In some embodiments, the brace 515 can enable the height of the first conduit 140 to be adjusted. The height of the first conduit 140 can be adjusted to account for, among other things, varying water levels or uneven floors 120.

When the water level in the retention area 135 reaches the level set by the sensor 155, the sensor 155 can activate the vacuum motor 505 on the water collection system 145. In some embodiments, the sensor 155 can be connected to a controller 510. The controller 510 can be for example a relay, which can enable a small switching current from the sensor to activate a large current for the vacuum motor 505. In other embodiments, the sensor 155 can be a float switch, or similar, that completes the power or ground circuit for the vacuum motor 505.

When the vacuum motor 505 is activated, water is drawn up the first conduit 140 into the reservoir 130. In some embodiments, the vacuum motor can run for a pre-determined amount of time (e.g., based on the size of the retention area 135). In other embodiments, the sensor 155 can provide a signal, or interrupt power to the motor 505, when the water drops to a certain level.

In some embodiments, the first conduit 140 can further comprise a valve 415. In some embodiments, the valve 415 can be a simple on/off valve such as, for example, a ball valve. This type of valve can be useful when installing or removing the system 100 to prevent water dripping from the first conduit 140. In some embodiments, the valve 415 can comprise a one-way, or backflow, valve. This can prevent water that has been sucked into the first conduit 140 from draining back into the retention area 135 when the water collection system 145 cycles off. The water collection system 145, therefore, removes the water from the retention area 135 to the enclosed reservoir 130. This minimizes the volume of standing water in the retention area 135.

The system 100 can further comprise a water removal system 165. The water removal system 165 can comprise a pump 525 in fluid communication with a second conduit 150. The water removal system 165 can further comprise a sensor 160. The sensor 160 can detect the water level in the reservoir 130. In some embodiments, pictured, the sensor 160 can be a float switch that activates and deactivates the pump 525. When the water level in the reservoir 130 reaches a first predetermined height in the reservoir 130, the switch can activate the pump 525. Similarly, when the water level in the reservoir reaches a second predetermined height, the switch can deactivate the pump 525.

The pump 525 can be in fluid communication with the second conduit 150 via a pipe 535. In some embodiments, the pipe 535 can be inside the reservoir 130. In some embodiments, the pipe 535 can be, for example and not limitation, PVC pipe, clear plastic tubing, or garden hose. The pipe 535 can be connected to a fitting 537 on the reservoir 130. The fitting 537 can enable the second conduit 150 to be detachably coupled to the pipe 535. In some embodiments, the fitting 537 can be a hose fitting (e.g., a garden hose fitting) and the second conduit 150 can be a hose (e.g., a garden hose). The second conduit 150 can be in fluid communication with a suitable means for removing the water from the structure 105. The second conduit 150 can be in fluid communication with, for example, a drain or the outside of the structure 105.

In some embodiments, the pipe 535 can further comprise a valve 530. In some embodiments, the valve 530 can comprise a one-way or backflow valve. This can prevent water that has been pumped into the pipe 535 from draining back into the reservoir 130 when the pump 525 is deactivated.

Based on size and electrical current requirements, it may be desirable for the vacuum motor 505 and pump 525 to be powered on separate circuits. The current requirements of the vacuum motor 505 and pump 525 may be higher than can be safely accommodated on a single residential circuit breaker. It may be desirable for the vacuum motor 505 and pump 525 to have separate power cords 540A, 540B so that they can be connected to outlets 550A, 550B on separate circuits. In some embodiments, the vacuum motor 505 and pump 525 can have lower power requirements and can be accommodated on a single circuit breaker. In some embodiments, the vacuum motor 505 and pump 525 can use a single power cord (not shown). In some embodiments, the system 100 can have an independent power source, such as, for example and not limitation, a battery pack or solar array.

Figure 6:
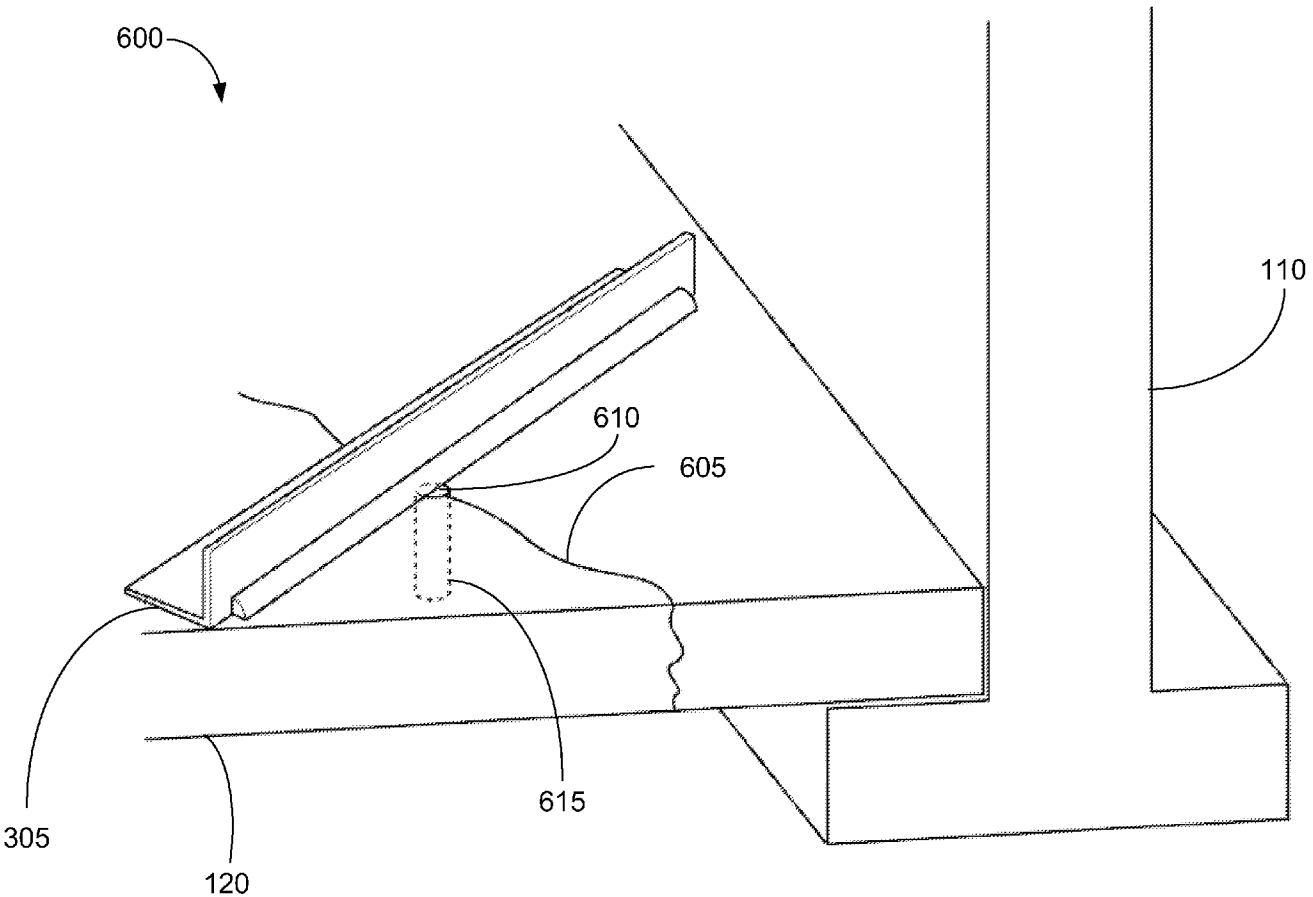
FIG. 6 depicts a perspective view of an embodiment of a dam of a water collection and removal system embodiment in accordance with some embodiments of the present invention.

FIG. 6 depicts a perspective view of an embodiment of a dam of a water collection and removal system embodiment in accordance with some embodiments of the present invention. Water infiltration into structures can be caused, at least in part, by cracks 605, or breaks, in foundation walls 110 or floors 120. The crack 605 can enable positive hydrostatic pressure behind the wall 110 or beneath the floor 120 to drive water into the structure 600. Creating a watertight seal across and through the crack 605 can be difficult because the crack 605 can cause an uneven surface, or void, where the dam 305 meets the floor 120 or wall 110. This can cause the water to follow the crack 605 under the dam.

To prevent leakage across and through the crack 605 it may be necessary to drill a hole 610 in the floor 120 and/or wall 110 in the vicinity of the crack. It is preferable that the crack 605 generally bisects the hole 610, if possible. Caulk, adhesive, or another suitable sealer 615 can then be pumped into the hole 610 until the hole 610 is slightly overfilled. The sealer 615 can provide a pliable surface across which the dam 305 can form a watertight seal. This can prevent water from leaking under the dam 305 via the crack 605. While illustrated using a crack in the floor 120, this method can also be employed effectively on the wall 110 by drilling a horizontal hole (not shown).

Figure 7:
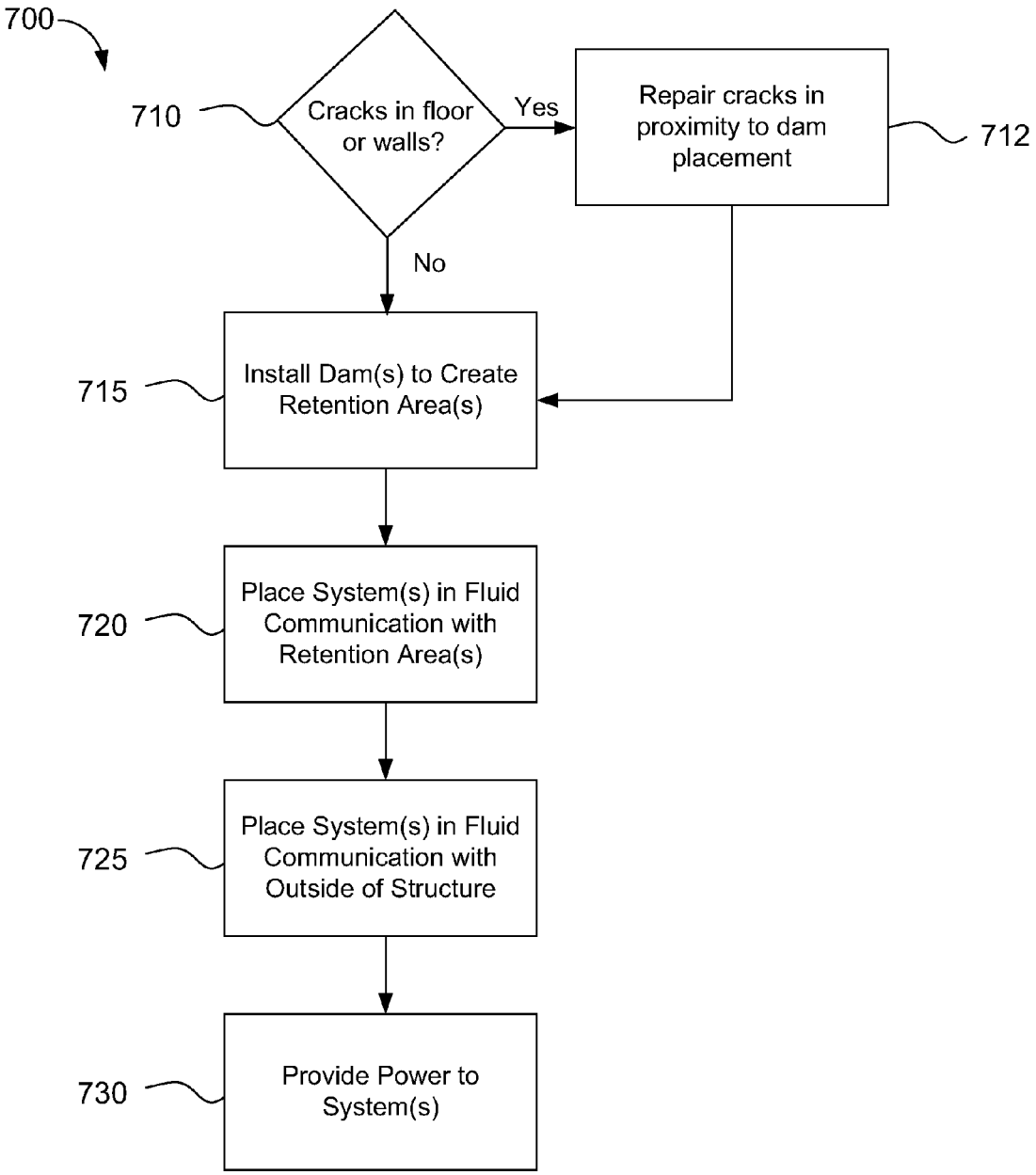
FIG. 7 is a flow chart depicting a method of use for the water collection and removal system embodiment in accordance with some embodiments of the present invention.

FIG. 7 is a flow chart depicting a method of use for the water collection and removal system embodiment in accordance with some embodiments of the present invention. In some embodiments, the method can be implemented using the above-discussed embodiments.

In some embodiments, at 710, it may be necessary determine if there are existing cracks in the floor or walls that must be repaired prior to installation of the dam. In some embodiments, at 712, it may be necessary to fill any cracks in the floor with a sealant. Filling the cracks 712 can enable the dam to form a watertight seal over and through the cracks. In some embodiments, such as with a particularly deep or wide crack, it may be necessary to first drill a hole in the crack. The hole can then be filled with a suitable sealant such as for example and not limitation, latex or silicone caulk, hydraulic cement, or polyurethane. This can enable the dam to form a watertight seal over the crack.

Next, at 715, one or more dams can be installed to create retention areas. The retention areas can be installed in the vicinity of the infiltration points for the water. In the case of a single leaking corner, for example, this can be as simple as placing a dam across the corner from wall to wall to create a triangular retention area. On the other hand, in a flood, it may be necessary to create a moat-like retention area all the way around the room. See, e.g., FIG. 2A.

After the retention area(s) have been established, at 720, one or more water collection and removal systems can be placed proximate to the retention areas. In some applications, it may be necessary to adjust the height of the first conduit based on the height of the retention area. This can allow for variations in the floor, for example. In some embodiments, it may be necessary or desirable to adjust the height of the sensor. In some embodiments, the height of the sensor can be set based on the height of the first conduit.

Next, at 725, the second conduit can be connected to the system to place the system. The second conduit can be in fluid communication with a suitable egress point for the water. In some configurations, an egress point can be an existing floor or tub drain. In other configurations, the second conduit can be run outside through a window, or other opening. In some installations, the second conduit can be run to, for example, an exterior storm drain.

At 730, the system can be connected to one or more power sources. In other words, in some installations, the pump and vacuum motor of the system can be plugged into outlets on separate circuits. In some embodiments, however, this can be unnecessary, e.g., if the circuit breaker in the structure has sufficient load capacity. If sufficient capacity exists, the pump and the vacuum motor can be plugged into the same outlet. In some embodiments, the pump and vacuum motor can have a common power cord. In still other embodiments, the system can have an on-board power supply such as, for example and not limitation, a battery pack obviating this step.

Upon installation, the system 100 can be configured to be substantially self-sufficient provided power is not interrupted. It can be desirable from time to time to check the system 100 and remove, for example, any accumulated debris from the vicinity of the first conduit 140 and to check the operation of the various components, e.g., the sensors 155, 160. The system 100 can be advantageous in times of high demand, when installers are suffering backlogs, for instance, and the system 100 can provide a means for keeping a structure with ongoing water infiltration substantially dry. The system 100 can be quickly deployed until a more permanent waterproofing solution can be installed It can be seen that embodiments of the present invention provide a system 100 and method 700 for providing a means for effectively removing water. In some embodiments, the present invention is a system 100 capable of containing and removing water from a structure. The water can then be removed to a drain inside the structure or a suitable location outside the structure. In some embodiments, the system 100 can comprise a dam 125, a water collection system 145, and a water removal system 165. In some embodiments, the dam 125 can sequester and collect water in a water retention area 135. This can facilitate water removal into the reservoir 130 of the system 100. When the reservoir 130 is sufficiently full, the water removal system 165 can remove accumulated water from the structure 105. The water can be removed via a drain, or other suitable means.

It can also be seen that embodiments of the invention provide a number of different systems 100 and methods 700. These systems 100 and methods 700 can be used to remove water from a structure 105 until permanent repairs can be affected. The system 100 can be easily adjusted to conform to a variety of structures 105 and water infiltration scenarios. Installed, embodiments of the present invention provide a safe, convenient, temporary solution to this ubiquitous problem. The various embodiments of the invention described above provide methods of using the system 100 and method 700 when compared with prior approaches.

It will be appreciated by those skilled in the art, however, that the invention can be embodied in other specific forms without departing from the spirit or essential characteristics of the invention. For example, embodiments of the invention have been described with respect to a method 700; however, the method 700 could be performed using a different sequence of steps, or omitting certain steps, without deviating from the spirit of the invention. For example, if upon inspection 710, no cracks are found in the floor 120 or walls 110, it can be unnecessary to drill and fill cracks 712 prior to installation of the dam(s) 715.

In addition, while the invention has been described in the context of system 100 for removing water from a structure 105, the concepts described herein need not be limited to these illustrative embodiments. For example, embodiments of the present invention could be used in many situations in which a user wishes to remove undesirable water from a variety of structures, such as, for example, a boat, recreational vehicle, underpass, or parking garage.

The specific configurations, choice of materials, and the size and shape of various elements could be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A system for removing water from an area comprising:

a dam removably attached to a floor, the dam in watertight communication with the floor and configured to sequester water in a retention area, the retention area defined at least in part by the dam and the floor;

a water collection system, in fluid connection with the retention area, for removing water from the retention area, the water collection system comprising:

a vacuum with a vacuum motor and a canister;

a first conduit in fluid communication with the retention area and the cannister; and a first sensor for activating and deactivating the vacuum motor based on the water level in the retention area;

wherein the vacuum motor draws water out of the retention area and into the canister of the vacuum via the conduit; and a water removal system for removing the water from the canister of the vacuum to a disposal location, the water removal system comprising:

a pump for removing water from the canister of the vacuum;

a second conduit with a first end and a second end, the first end of the second conduit detachably coupled to the pump, and the second end of the second conduit in fluid communication with the disposal location; and a second sensor for activating and deactivating the pump based on the water level in the canister.

2. The system of claim 1, wherein the dam is in watertight communication with the floor and one or more walls.

3. The system of claim 1, wherein the second end of the second conduit is in fluid communication with a drain disposed inside a structure and the drain is in fluid communication with the disposal location.

4. The system of claim 1, wherein the first sensor activates the vacuum motor when the water level in the retention area reaches a first predetermined level; and the first sensor deactivates the vacuum motor when the water level in the retention area reaches a second predetermined level.

5. The system of claim 1, wherein the second sensor activates the pump when the water level in the canister of the vacuum reaches a first predetermined level; and the second sensor deactivates the pump when the water level in the canister of the vacuum reaches a second predetermined level.

6. The system of claim 1, the first conduit further comprising a valve to prevent water from draining out of the first conduit and back into the retention area when the vacuum motor is deactivated.

7. The system of claim 6, the first conduit further comprising a nozzle, in fluid communication with the first conduit and the retention area, the nozzle comprising a plurality of channels to channel water into the first conduit.

8. The system of claim 1, wherein the second conduit further comprises a second valve to prevent water from draining out of the conduit and back into the canister of the vacuum when the pump is deactivated.

9. The system of claim 1, wherein the system can be installed and removed from a structure without making permanent modifications to the structure.

10. A system for removing water comprising:

a flexible dam, in watertight communication with a floor and at least one wall, for sequestering water in a retention area defined at least in part by the dam, the floor, and the at least one wall;

a water collection system comprising:

a first conduit in fluid communication with the retention area;

a vacuum comprising a canister and a vacuum motor, the vacuum motor operable to draw water out of the retention area and into the canister of the vacuum via the first conduit; and a first sensor for controlling the vacuum motor based on the water level in the retention area; and a water removal system comprising:

a pump for removing water from the canister of the vacuum, the pump disposed at least partially within the canister of the vacuum;

a second conduit with a first end and a second end, the first end of the second conduit detachably coupled to the pump, and the second end of the second conduit in fluid communication with a disposal location;

a baffle for smoothing the flow of water out of the second end of the second conduit; and a second sensor for controlling the pump based on the water level in the reservoir canister.

11. The system of claim 10, further comprising a sealer for forming a substantially watertight seal between the dam and one or more of the floor and one or more walls.

12. A method for removing water comprising:

installing a removable dam on a floor by placing the dam in watertight communication with the floor and at least one wall to create a watertight retention area defined at least in part by the dam and the floor;

placing a water collection system in fluid communication with the retention area, the water collection system comprising a vacuum with a canister;

placing a water removal system at least partially within the canister of the vacuum and in fluid communication with the canister of the vacuum and a disposal location; and providing the water collection and removal systems with a power source.

13. The method of claim 12, wherein installing the dam further comprises:

covering a portion of a bottom side of the dam with a sealant;

covering a portion of one or more side surfaces of the dam with the sealant; and placing the dam in communication with the floor to form a substantially watertight retention area.

14. The method of claim 12, further comprising adjusting the height of a first conduit within the retention area such that the first conduit is in close proximity to the floor.

15. The method of claim 12, wherein the disposal location comprises an existing drain.

16. The method of claim 12, further comprising:

drilling a hole in a crack in one or more of the floor and one or more walls where the dam will span the crack after installation; and filling the hole with a sealant prior to installing the dam to create a water tight seal between the dam and one or more of the floor and the one or more walls after installation.

* * * * *